US005547270A

United States Patent [19]

Dang

[11] Patent Number: 5,547,270

[45] Date of Patent: Aug. 20, 1996

[54] COMPACT DESK WITH LOCKING ENCLOSURE

[76] Inventor: Anh H. Dang, 202 S. 30th Ave. Apt. 105, Hattiesburg, Miss. 39401

[21] Appl. No.: 424,192

[22] Filed: Apr. 19, 1995

[51] Int. Cl.[6] ..... A47B 17/03; A47B 19/08; A47B 27/00

[52] U.S. Cl. ..... 312/194; 312/235.3; 312/235.2; 297/143; 297/140

[58] Field of Search ..... 312/194, 235.2, 312/235.3, 235.5, 235.9, 294; 297/139, 140, 143

[56] References Cited

U.S. PATENT DOCUMENTS

| | | | |
|---|---|---|---|
| Re. 16,410 | 8/1926 | Woolman | 297/143 X |
| D. 159,534 | 8/1950 | Raichert | 297/140 X |
| D. 165,554 | 12/1951 | Schukat | 297/140 X |
| D. 166,006 | 2/1952 | Trumfio | 297/140 X |
| 187,429 | 2/1877 | Sykes | 312/235.3 |
| 371,168 | 10/1887 | Boss | 312/235.3 X |
| 1,254,969 | 1/1918 | Blayney | 312/235.2 X |
| 1,264,474 | 4/1918 | Baker | 312/235.3 X |
| 1,315,344 | 9/1919 | Shparago | 297/143 |
| 1,339,669 | 5/1920 | Rapp | 297/143 |
| 2,495,374 | 1/1950 | Horn | 312/235.3 X |
| 2,660,502 | 11/1953 | Smith | 312/194 X |
| 3,213,467 | 10/1965 | Hubbard | 312/235.2 X |
| 3,230,006 | 1/1966 | Sokolis | 312/235.2 X |
| 3,353,865 | 11/1967 | Bass | 297/140 X |
| 3,545,809 | 12/1970 | Krenz | 312/235.2 |
| 3,650,560 | 3/1972 | Wohlik | 297/140 |
| 4,325,596 | 4/1982 | Bell | 312/194 |
| 5,100,198 | 3/1992 | Baltzell | 312/235.2 |
| 5,281,017 | 1/1994 | Geiss, II | 312/194 |

FOREIGN PATENT DOCUMENTS

| | | | |
|---|---|---|---|
| 128016 | 7/1948 | Australia | 312/194 |
| 160926 | 2/1955 | Australia | 312/235.3 |
| 2613918 | 10/1988 | France | 312/235.3 |
| 388733 | 1/1924 | Germany | 312/235.3 |
| 4307003 | 10/1992 | Japan | 312/235.3 |
| 645615 | 11/1950 | United Kingdom | 312/194 |

OTHER PUBLICATIONS

Yawman and Erbe Manufacturing Company, May 3, 1954.

*Primary Examiner*—Peter M. Cuomo
*Assistant Examiner*—Rodney B. White
*Attorney, Agent, or Firm*—Terrance L. Siemens

[57] ABSTRACT

A novel compact work desk assembly which is completely contained within a single locking enclosure. The assembly includes a chair with a fold-down backrest, multiple drawers contained within a drawer assembly, at least two extendible work surfaces, and at least two footrests. The chair rests atop the drawer assembly which is slidably disposed within the enclosure. Since the seat is supported by the drawer assembly, virtually no extra space is required inside the enclosure to store the seat. Additional space saving is achieved by having the drawer assembly slide out of the enclosure in a first direction, with the individual drawers opening in the opposite direction. The footrest support has at least two footrest bars so that users of different height can be accommodated.

6 Claims, 3 Drawing Sheets

32
40
26
30
30
28
34
36
31
38
24
22
20
10

COMPACT DESK WITH LOCKING ENCLOSURE

BACKGROUND OF THE INVENTION

1. Field of the Invention

The present invention relates to compact furniture enclosures. More specifically, it relates to an improved compact desk enclosure which can be used by children or adults. The desk reversibly converts from an open or deployed position by folding into a compact condition.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

Compact or folding furniture arrangements are old and well known in the art. As will be seen, the simplicity and effectiveness of my invention is not rivaled in the prior art.

U.S. Pat. No. 4,736,998, issued to Wilson et al. on Apr. 12, 1998, shows a compact work bench with a seat attached to the interior of a cabinet-like enclosure. The seat can be nested within the enclosure when not in use. The enclosure has some interior storage space but does not include separate compartments or drawers. The work surface of the work bench is limited to the area of the top surface of the enclosure. By contrast, the device of the present invention includes at least three enclosed storage compartments or drawers. Also, the work surface area can be selectively increased.

U.S. Pat. No. 2,351,610, issued to Hamberg on Jun. 20, 1944, shows a combined cabinet, desk, and table. The combination does not include a chair. By contrast, the device of the instant invention is a completely self contained work station including a desk, chair and plural storage compartments.

U.S. Pat. No. 1,568,498, issued to Caliver on Jan. 5, 1926, shows a work cabinet including a chair which can be enclosed within a cabinet-like enclosure. The work cabinet includes a plurality of drawers which cannot be enclosed within the cabinet-like enclosure. By contrast, the device of the instant invention has a plurality of drawers or compartments which can be enclosed within an enclosure. Thus, none of the drawers can be accessed when the enclosure is closed.

U.S. Pat. No. 2,628,879, issued to Schultz on Feb. 17, 1953, shows a night stand having a drawer section and a night stand section. A foot stool is slidably disposed within the drawer section. By contrast, the device of the instant invention has a single enclosure within which all components can be contained.

All of the prior art devices with seats suffer from the drawback that the seats have no backrests making them uncomfortable to sit on for extended periods.

None of the above inventions and patents, taken either singly or in combination, is seen to describe the instant invention as claimed.

SUMMARY OF THE INVENTION

Briefly, the invention comprises a compact work desk assembly which can be completely contained within a single locking enclosure. The assembly includes a chair with a fold-down backrest, multiple drawers contained within a drawer assembly, at least two extendible work surfaces located in vertically spaced apart relation, and at least two footrests. The chair rests atop the drawer assembly which is slidably disposed within the enclosure. Since the seat is supported by the drawer assembly, virtually no extra space is required inside the enclosure to store the seat. Additional space saving is achieved by having the drawer assembly slide out of the enclosure in a first direction, with the individual drawers opening in the opposite direction. The footrest support has at least two footrest bars which are horizontally spaced apart so that users of different height can be accommodated.

Accordingly, it is a principal object of the invention to provide a new and improved compact desk with locking enclosure which overcomes the disadvantages of the prior art in a simple but effective manner.

It is a major object of this invention to provide a compact desk assembly which can be contained within a single locking enclosure.

An additional object of the invention is to become fully enclosed when folded into its compact condition.

It is again an object of the invention that drawers open in a direction opposite that employed to extend the drawers from the compact desk.

It is another object of the invention to provide a compact desk assembly which includes storage compartments or drawers which can be contained within the locking enclosure.

It is another object of the invention to provide a compact desk assembly which includes a seat having a backrest which can fold down.

It is another object of this invention to provide a compact desk assembly which has plural, vertically spaced apart horizontal work surfaces.

It is another object of this invention to provide a compact desk assembly which has multiple footrests which are horizontally spaced apart, in order to accommodate users of different height.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
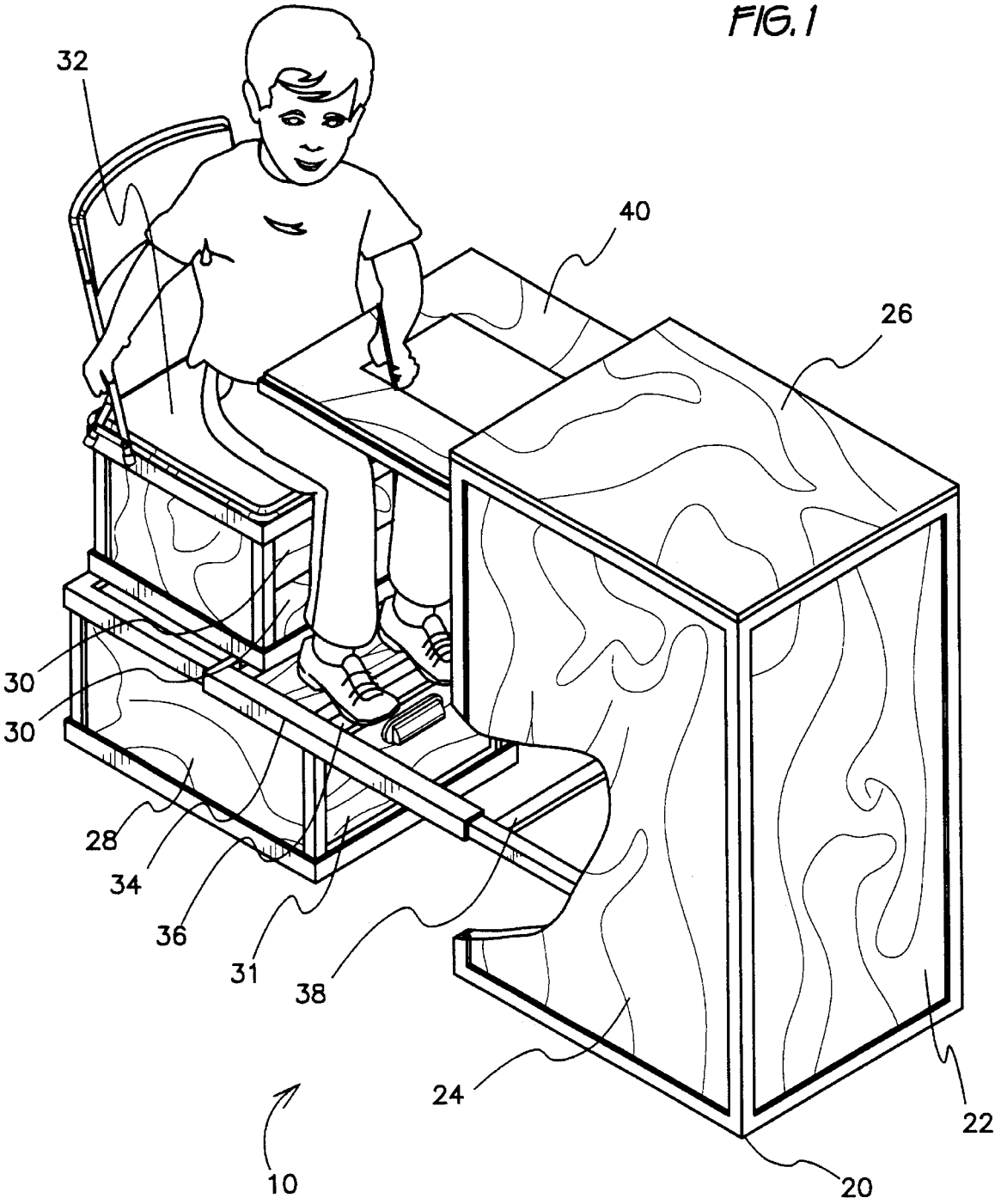
FIG. 1 is a partially broken away perspective view of the compact desk assembly of the present invention with the drawer assembly extended.

The compact desk with locking enclosure of the present invention is generally designated by arrow 10 of FIG. 1. The device includes an enclosure 20 having a rear panel 22, side panels 24, and a top panel 26. A drawer assembly 28 can be slidably disposed within the enclosure 20, the drawer assembly 28 including a plurality of drawers 30 and a chair 32 affixed to the topmost drawer 30. Lower drawer 31 is larger than top drawers 30. The drawer assembly 28 is extended and retracted via telescoping guide rails 34, the guide rails 34 also acting as a support for footrests 36 and 38. Footrest 36 is relatively close to the chair 32 and is convenient for small users such as children, while footrest 38 is relatively far from the chair 32 and is convenient for adults. Of course, additional footrests could be supported by guide rails 34 if desired. A work surface 40 can be extended from the enclosure 20. An additional work surface/storage space can also be extended from the enclosure 20 as will be discussed later.

The enclosure 20 can be constructed with an outside finish that will be compatible with usual and ordinary household furniture. The invention 10 is particularly adapted for use where space is at a premium such as dorm rooms, small apartments, etc. The invention 10 is constructed to maximize work surface area and storage space while simultaneously minimizing the floor space needed especially when the drawer assembly 28 is retracted.

Figure 2:
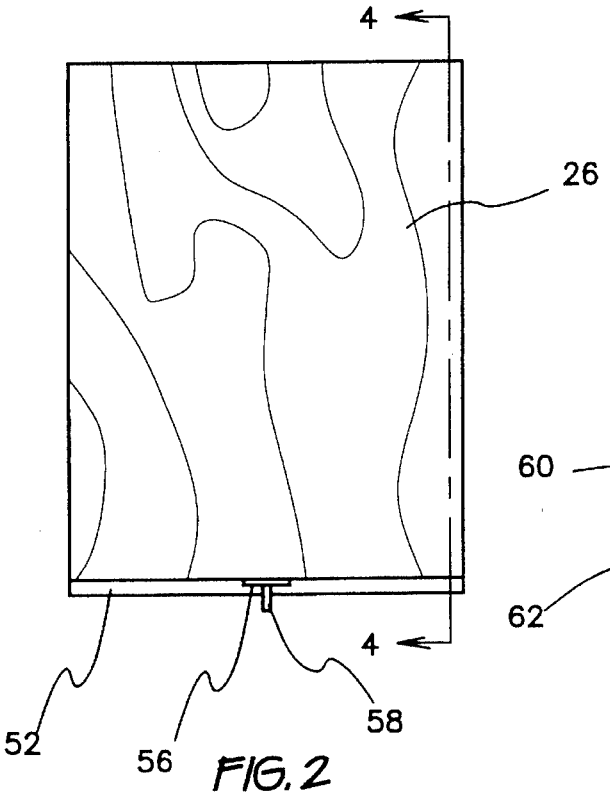
FIG. 2 is a top view of the device of the present invention.
Figure 3B:
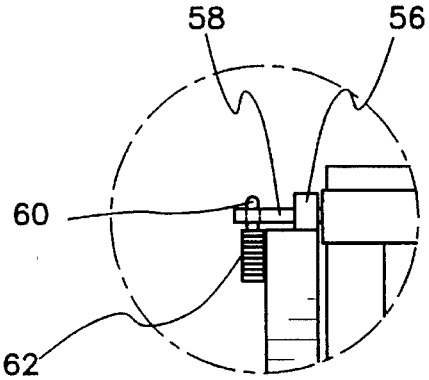
FIG. 3B is an enlarged, side elevational detail view of the lock mechanism, taken from the upper left of FIG. 3A.
Figure 3A:
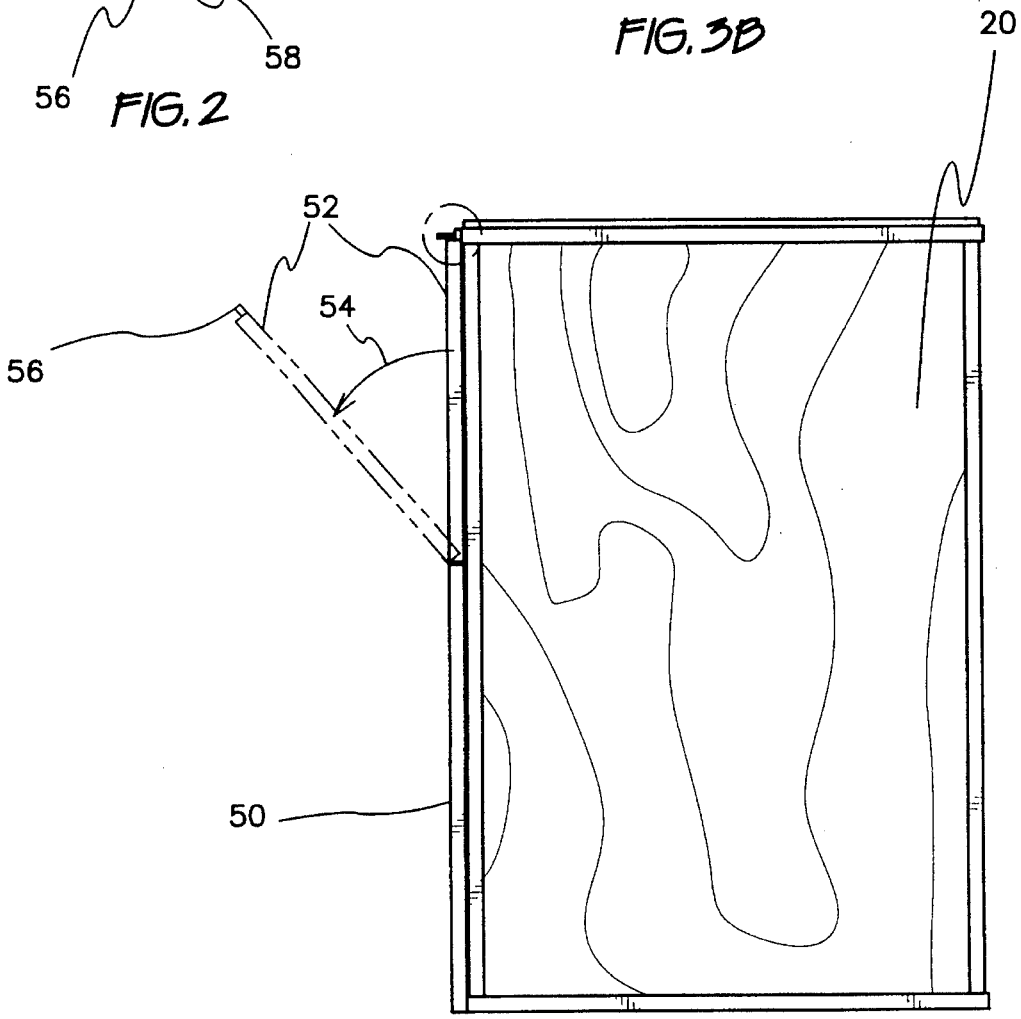
FIG. 3A is a side elevational view of the device of the present invention, with the drawer assembly retracted.

Referring now to FIGS. 2 and 3, The enclosure 20 is shown with the drawer assembly 28 and chair 32 retracted. The drawer assembly 28 includes front panels 50 and 52. Panel 52 is hingedly connected to panel 50 and can be swung between closed and open positions as indicated by arrow 54. Panel 52 includes a locking tab 56 which has a central aperture (not shown) for allowing locking post 58 to pass therethrough. The locking post 58 includes an aperture for allowing the shackle 60 of lock 62 to pass therethrough thereby locking panel 52 into the closed position. Thus, the entire assembly can be lockably contained within the enclosure 20.

It will be apparent from FIGS. 1 and 3 that when drawer assembly 28 is slid entirely into enclosure 20 and locking panel 52 is in the closed position, enclosure 20 is fully enclosed. No opening or gap is present which yields access into the interior of enclosure 20.

Figure 4:
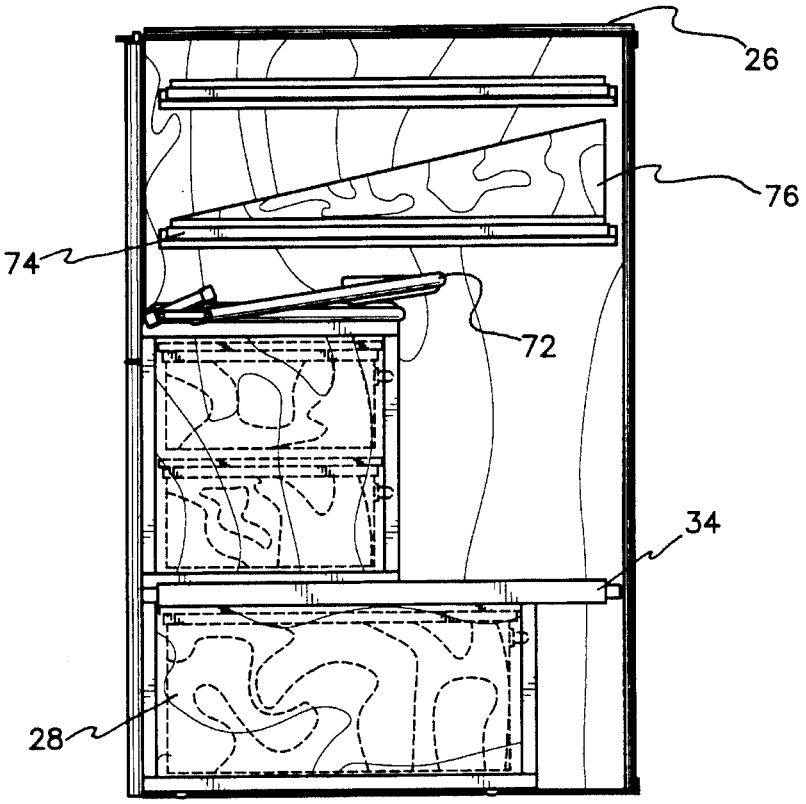
FIG. 4 is a broken away side view of the device of the present invention with the drawer assembly retracted.
Figure 5:
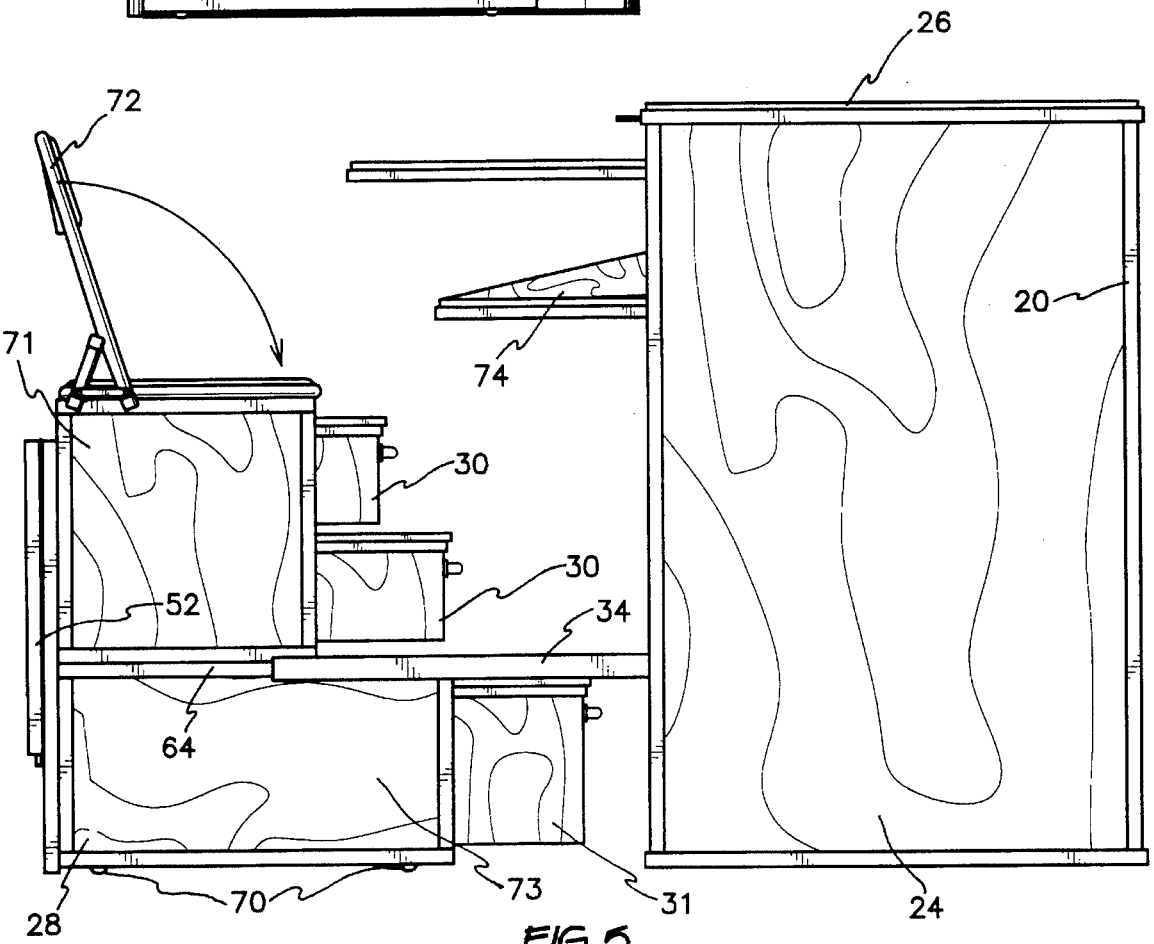
FIG. 5 is a side view of the device of the present invention with the drawer assembly extended.

Referring now to FIGS. 4 and 5, telescoping guide rail 34 is slidably connected to a stationary guide rail (not shown) which is secured to the interior surface of panel 24. A second telescoping guide rail 64, coaxially extending within guide rail 34, is integral with the drawer assembly 28. Thus a guide rail assembly consisting of a stationary guide rail, a first telescoping guide rail 34, and a second telescoping guide rail 64, allow for smooth extension (opening) and retraction (closing) of the drawer assembly 28. Each of the telescoping guide rails 34 and 64 have means for limiting their travel so that the drawer assembly 28 does not become completely disconnected from the enclosure 20. Any of several well known guide rail assemblies having travel limiting means may be used for this purpose.

Casters or wheels 70 attached to the bottom of the drawer assembly 28 also help to smooth transport of the drawer assembly 28 between the open and closed positions.

Side panels 71 and 73 of the drawer assembly 28 may include stationary guide rails (not shown) affixed to the interior surfaces thereof which are coaxially aligned and slidingly engaged with telescoping rails (not shown) for providing smooth operation of the drawers. Work surfaces 40 and 74 may have a similar structure. It would be desirable to have a means for limiting the travel of both the drawers 30 and the work surfaces 40 and 74 to prevent inadvertent removal during extension. Any of several well known arrangements may be used such as, e.g., roller stops for the guide rails which require a tilt and lift out motion when the drawer reaches the limit of travel.

As can be seen clearly in FIG. 4, the interior space needed for the enclosure 20 is minimized by having the backrest 72 of the chair 32 fold down to lay upon the seat of the chair 32, thus allowing space for a second work surface/storage area 74 which can be extended from the enclosure 20. The second work surface 74 includes sloping sidewalls 76 designed to restrain any loose objects which may be placed thereon. It should be noted that while many compact furniture assemblies have simple benches and the like with no backrests, the present invention contemplates a compact desk assembly which can be used for long periods without any of the discomfort associated with the prior art devices. Accordingly, both the backrest 72 and footrests 36 and 38 are provided.

Further space saving is accomplished by having the chair 32 affixed to the top of the drawer assembly 28. By employing this arrangement, the only space needed inside the enclosure 20 for the chair 32 is the limited space required for the backrest 72. The drawer assembly 28 supports the weight of the user while also providing storage area in the form of drawers 30.

The drawers 30 open in the opposite direction of the drawer assembly 28. In the devices of the prior art, the drawers open either to the side, or otherwise extend outwardly from an enclosure. The drawers 30 of the present invention 10 can be opened and closed without requiting any additional space to the sides, front, or rear. Thus, the present invention 10 contemplates a compact desk assembly which uses space efficiently both when in use and while retracted into the dosed position.

In operation, the invention 10 can be extended into the open position by removing the lock 62 and swinging panel 52 downwardly as shown in FIG. 3 until it is resting against panel 50. The drawer assembly 28 can then be extended from the enclosure 20 until guide rails 34 and 64 reach their limits of travel. The backrest 72 can then be folded up and the invention 10 is ready for use. When not in use, the enclosure can be locked by simply reversing the above steps. It can be readily appreciated that any papers or objects stored on work surfaces 40 and 74 or in drawers 30 are locked inside the enclosure 20 when the swinging panel 52 is locked. Of course, if extra security is desired, the individual drawers could have a separate locking mechanism.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily substitute an additional drawer for second work surface/storage area 74.

It is to be understood that the present invention is not limited to the sole embodiment described above, but encompasses any and all embodiments within the scope of the following claims:

I claim:

1. A compact desk assembly having front, side, rear, and top surfaces, said compact desk assembly being selectively extensible into an open position and folded into a compact condition, said compact desk assembly comprising:

an enclosure having a rear panel, opposed side panels, a top panel, and means for closing the front of said compact desk, said rear panel, said opposed side panels, said top panel, and said means for closing the front of said compact desk combining to fully enclose said compact desk when said compact desk is folded into said compact condition;

a drawer assembly having means for extending from said enclosure in a first direction and for retracting into said enclosure, and a drawer having means for extending from said drawer assembly in a second direction opposite said first direction;

a first horizontal work surface having first means for extending from said enclosure and for retracting into said enclosure;

a second horizontal work surface having second means for extending from said enclosure and for retracting into said enclosure, and means for spacing said second horizontal work surface vertically apart from said first horizontal work surface, said first horizontal work surface and said second horizontal work surface each being independently extensible from said enclosure with respect to one another; and a chair affixed to said drawer assembly.

2. The compact desk assembly according to claim 1, said chair further comprising a backrest, a seat, and means for enabling said backrest to fold onto said seat of said chair, said seat disposed upon said drawer assembly.

3. The compact desk assembly according to claim 1, further comprising means for accepting a lock and for locking said compact desk assembly in said compact condition.

4. The compact desk assembly according to claim 1, further comprising a first footrest attached to said compact desk assembly.

5. The compact desk assembly according to claim 4, further comprising a second footrest attached to said compact desk assembly in a location horizontally spaced apart from said first footrest.

6. A compact desk assembly having front, side, rear, and top surfaces, said compact desk assembly being selectively extensible into an open position and folded into a compact condition, said compact desk assembly comprising:

an enclosure having a rear panel, opposed side panels, a top panel, and means for closing the front of said compact desk, said rear panel, said opposed side panels, said top panel, and said means for closing the front of said compact desk combining to fully enclose said compact desk when said compact desk is folded into said compact condition;

a drawer assembly having means for extending from said enclosure in a first direction and for retracting into said enclosure, and a drawer having means for extending from said drawer assembly in a second direction opposite said first direction;

a chair affixed to said drawer assembly, said chair further comprising a backrest, a seat, and means for enabling said backrest to fold onto said seat of said chair, said seat disposed upon said drawer assembly;

a first horizontal work surface having first means for extending from said enclosure and for retracting into said enclosure and a second horizontal work surface having second means for extending from said enclosure and for retracting into said enclosure, and means for spacing said second horizontal work surface vertically apart from said first horizontal work surface, said first horizontal work surface and said second horizontal work surface each being independently extensible from said enclosure with respect to one another;

a first footrest attached to said compact desk assembly, and a second footrest attached to said compact desk assembly in a location horizontally spaced apart from said first footrest; and means for accepting a lock and for locking said compact desk assembly in said compact condition.

* * * * *